US007111828B2

(12) United States Patent
Rosine et al.

(10) Patent No.: US 7,111,828 B2
(45) Date of Patent: Sep. 26, 2006

(54) STACKABLE OUTDOOR SCREEN FENCE

(75) Inventors: Lyle A. Rosine, Oswego, IL (US); Torrence Anderson, Overland Park, KS (US); Robert Kopp, Wheaton, IL (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 11/003,770

(22) Filed: Dec. 2, 2004

(65) Prior Publication Data

US 2006/0118772 A1 Jun. 8, 2006

(51) Int. Cl.
*E04H 17/00* (2006.01)

(52) U.S. Cl. ..... 256/24; 256/19; 256/25; 256/26

(58) Field of Classification Search ..... 256/1, 256/19, 21, 24, 25, 26, 27; 160/135; D25/38, D25/40, 58
See application file for complete search history.

(56) References Cited

U.S. PATENT DOCUMENTS

| | | | | |
|---|---|---|---|---|
| 42,166 | A | 4/1864 | Clapp et al. | |
| 174,973 | A | 3/1876 | Parker et al. | |
| 197,806 | A | 12/1877 | Walter | |
| 326,902 | A | 9/1885 | Ewer | |
| 3,229,738 | A * | 1/1966 | Bianchini | 81/21 |
| 3,484,081 | A * | 12/1969 | Rowan | 256/22 |
| 4,174,096 | A | 11/1979 | Campbell | |
| 4,498,660 | A | 2/1985 | Brema et al. | |
| 4,930,753 | A | 6/1990 | Alvyn | |
| 5,601,279 | A * | 2/1997 | Schwartz et al. | 256/66 |
| 5,609,327 | A * | 3/1997 | Amidon | 256/24 |
| D427,322 | S | 6/2000 | DeSouza | |
| 6,190,084 | B1 * | 2/2001 | Ibanez | 404/6 |
| 6,286,284 | B1 | 9/2001 | Cantley | |
| 6,308,487 | B1 | 10/2001 | Cantley | |
| 6,374,560 | B1 * | 4/2002 | Schiedegger et al. | 52/475.1 |
| 6,398,193 | B1 | 6/2002 | DeSouza | |
| 6,676,113 | B1 * | 1/2004 | Christensen et al. | 256/25 |
| 6,772,998 | B1 | 8/2004 | Bebendorf | |
| 2002/0014619 | A1 * | 2/2002 | Christensen et al. | 256/25 |
| 2003/0197165 | A1 * | 10/2003 | Perelli | 256/26 |

* cited by examiner

*Primary Examiner*—Daniel P. Stodola
*Assistant Examiner*—Daniel J. Mills
(74) *Attorney, Agent, or Firm*—McHale & Slavin PA

(57) ABSTRACT

An outdoor screen fence is made up of a series of molded panels with simulated paneling and lattice in relief bounded on each lateral side by a leg. Each leg has a plurality of brackets along the length thereof. The brackets on one leg are disposed intermediate the brackets on the other leg. Each of the brackets has an aperture therethrough for receiving a tubular fence post. In assembly, the brackets of different panels are aligned in an interspersed relationship and a fence post with a removable impact cap is inserted through the apertures and driven into a support surface such that each leg is supported by at least two brackets.

15 Claims, 6 Drawing Sheets

STACKABLE OUTDOOR SCREEN FENCE

FIELD OF THE INVENTION

The present invention relates to the field of prefabricated fencing panels and, in particular, to a decorative polymeric fence construction that is lightweight and permits shipping in a stacked array.

BACKGROUND OF THE INVENTION

There are numerous examples of prefabricated fence sections that can be assembled to form a continuous structure. Earlier prefabricated fences were assembled from individual sections made of wood. Usually, each section had a fence post at each end for anchoring in the ground. Other fence sections were made with pilings or panels attached to supporting frame members and the frame members were assembled to pre-set fence posts U.S. Pat. No. 42,166, discloses a portable fence. The fence consists of panels of longitudinal strips attached parallel to upright bars, a single nail or bolt passing through the strips and bars at the intersections. The panels are connected together and secured to the ground by means of stakes which pass through metal loops or eyes attached to the ends of the panels. The panels may be arranged in straight line, zigzag or other form and may be utilized on level or inclined ground.

U.S. Pat. No. 174,973, discloses a portable fence. The fence consisting of panels, constructed of a number of rails secured together by vertical bars. Eyelets are secured to the ends of the rails by tangs fitting in grooves along the rails. The panels are connected together and secured to the ground by means of stakes which pass through the eyelets attached to the ends of the panels. A brace consisting of a stanchion is placed about midway along the length of the panels. The stanchion includes looped ends through which stakes are driven into the ground to secure the panels.

U.S. Pat. No. 197,806, discloses a portable fence. The fence consisting of panels, constructed of a number of rails secured together by vertical bars. Eyelets are secured to the ends of the rails and stakes having hooks secured thereto are driven into the ground through the eyelets until the hook contacts the uppermost eyelet.

U.S. Pat. No. 326,902, discloses a farm fence constructed of a number of rails secured together by vertical bars. Wire strands extend between the upper portions of the vertical bars to prevent livestock from leaning against the fence sections and eyelets are secured to the ends of the rails. Stakes having hooks secured thereto are driven into the ground through the eyelets until the hook contacts the uppermost eyelet.

More recently, wood, wire and ropes have been replaced with man-made materials such as polymers, pressed board, fiberglass, etc. These materials offer advantages in uniformity of shape, ease of assembly, upkeep, and longevity. One such prefabricated fence is disclosed in U.S. Pat. No. 6,772,998. The fence assembly comprises a plurality of post members, a plurality of rail members and a plurality of paling members. The post members are connected to the rail members via openings on the inside face of the post members and projections at the end of the rail. The connection between the paling members is established by passing the paling members through a plurality of openings in the rail members. The bottom of the post member may be connected to a foot. Typically the foot is a precast concrete block. The block may have a cavity extending downwardly from the top wall to a depth suitable to hold the fence post. The cavity may be enlarged at one side to accept a holding wedge.

U.S. Pat. No. 4,174,096, discloses a fence characterized by interchangeably mountable fence sections each having a front and a rear surface, and parallel pairs of vertical and horizontal edges. A mounting member having a mast-receiving opening therein is disposed adjacent each vertical edge of the wall portion of each of the fence sections. Each mounting member has a mating surface thereon disposed in the same plane as the mating surface provided on the other mounting member. When the first mating surface on the wall portion of a first fence section is matingly engaged with a mating surface provided on the other of the mounting members on a next-adjacent fence section, the mast-receiving openings therein are disposed in vertical registration. The fence section, including the wall portions and the mounting members, are integrally fabricated of a plastic material.

U.S. Pat. No. 4,930,753, discloses a moldable edge connecting apparatus that can optionally be employed as a hinge. It is suitable for use as fencing and is particularly applicable to removable fencing. It employs integrally molded connecting fingers that are designed without deep slots, lips thereover, or fully circumscribed openings. The entire structure is substantially coplanar with segments to be connected, even when used as a hinge, and utilizes half-round grooves that are substantially no deeper than the radius of the groove.

U.S. Pat. No. 4,498,660, discloses a fence structure consisting of modular panels mounted on posts. The modular panels are of thermoplastic or thermoset material having a rail portion and a connector at each end for fitting over the posts. The connector has an integral expansion joint in its central passage and each connector is offset in opposite directions to the longitudinal center of the panel to provide a hinged effect with the connectors of adjacent panels in the fence. The construction is readily adaptable to sloping ground and variation in height between panels and provides simplified installation-by easy alignment.

U.S. Pat. No. 3,484,081, discloses a pre-fabricated picket fence. The picket fence consists of a series of repeating units hingedly engaged with each other to form a fence. Each unit includes a vertically elongated picket and a pair of rails mounted to each picket. One rail is mounted adjacent the upper portion of the picket and one rail is mounted adjacent the lower portion of the picket. Each rail having a tongue horizontally extending from one side of the picket and a pair of flanges forming a groove adapted to receive a tongue extending from the other side of the picket. The tongues and flanges are vertically aligned and a sharpened dowel is placed through aligned apertures and driven into the ground to secure the fence.

U.S. Pat. No. 5,609,327, discloses a portable fence panel for use on a support surface. The fence includes a rectangular frame member having a pair of side frame portions and a top and bottom frame portion. The frame portions have an outer and inner surface defining an aperture through the frame member. The panel includes cross-members in the frame aperture for restricting passage therethrough. One of the side frame portions has at least one first connector portion extending therefrom defining a connector surface and having at least one aperture therethrough. The panel also includes at least one second connector portion extending-from the other side frame portion having a connector surface which is substantially coplanar with the connector surface of the first connector portion. The second connector portions extend in a direction opposite the first connector portion and have at least one aperture therethrough. The panel also includes supports extending from the bottom frame portion. The supports have a contact portion supported by the support surface and a connector portion having at least one aperture therethrough. To connect a plurality of fence panels, a pin is positioned through one of the connecting portion apertures in a connector portion of a first and second panel and a second pin is positioned in a second connector portion aperture of the first panel and a connector portion aperture in a third panel.

U.S. Pat. No. D427,322, illustrates an ornamental design for a fence section. having a cross lattice shape on the upper portion and a vertical lattice shape on the lower portion.

Included in the broad field of prefabricated fencing, lattice screens are well known for decorative use, as well as, for providing a barrier. One advantage of this structure is the lessened wind resistance. The lattice is usually mass produced of a series of small thin longitudinal pieces laid over a series of small thin lateral pieces at a ninety degree angle and fastened together leaving interstices of varying sizes. Again, the traditional wooden construction has given way to plastics and other synthetic materials. Examples of such structures are found in U.S. Pat. Nos. 6,398,193; 6,308,487 and 6,286,284.

Typically the prior art utilizes rectangular corner posts and are thus designed for joining in straight lines or right angles. For example, the posts generally have bores or slots extending through the posts at right angles to each other allowing the panel supports to be aligned or oriented normal to each other. Any other angular relationship may require some modification of the posts or the panel sections or both.

Prior art fences are also semi-permanent in that placement of the fence posts usually results in a post anchored into a hole in the ground that may be filled with concrete. Adjustment of the fence requires substantial labor.

In addition the prior art fencing is heavy and difficult to ship. The sections must be dismantled and the pieces spaced apart within the packaging to prevent damage during shipment.

What is needed in the art is a fencing system that provides secure privacy, adaptability in layout, ease of changing the fence line and can be installed without damage to the fence posts. The fencing system should also be lightweight and should be constructed for stacked packaging in a nested arrangment for ease of shipment.

SUMMARY OF THE PRESENT INVENTION

An objective of this invention is to provide a low-cost fence that is lightweight, highly durable, easy to install, and provides a visual barrier to screen an interior area from view.

Another objective of this invention is to provide preconstructed fence panels that are stackable in a nested configuration for storage and shipping purposes.

A further objective of this invention is to provide identical molded panels with integrally formed reinforced brackets on each end of the panels disposed to interlock with a tubular fence post such that a series of panels can be installed along uneven surfaces.

Yet another objective of this invention is to provide fence posts cooperating with the interlocking brackets to link the panels together and anchor the panels to the ground without damage to the fence posts.

Still yet another objective of this invention is to provide the brackets and posts with complementary shape permitting the panels to be assembled in an infinite angular array.

A still further objective of this invention is to provide a novel bracket configuration which provides increased strength characteristics using minimal plastic.

Still yet a further objective of this invention is to provide legs at each end of each panel extending below the lower margin for ground clearance.

SHORT DESCRIPTION OF THE DRAWINGS

DETAILED DESCRIPTION OF THE INVENTION

Figure 1:
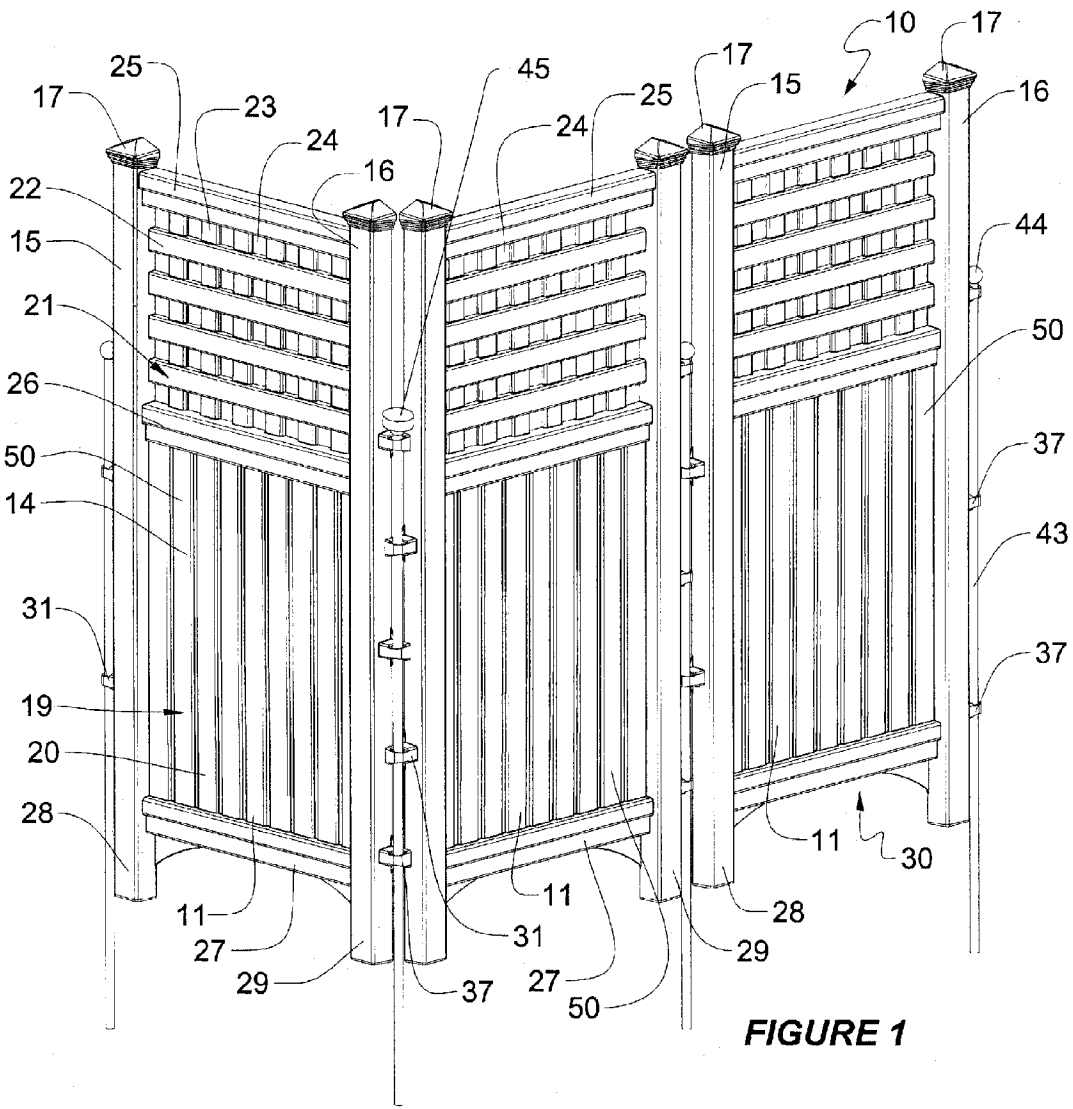
FIG. 1 is a perspective of the outdoor screen fence of this invention showing the fence posts.

The outdoor screen fence 10, shown in FIG. 1, is composed of three fence sections 11, though the number of fence sections is a matter of choice. For illustrative purposes, the end fence section is oriented at an angle to the line of the other two fence sections. It should be noted that the fence may be erected with the fence sections at any angle with respect to adjacent sections for aesthetics, as well as stability, and to form various shaped enclosures. Each of the fence sections has the same components which are given the same reference numbers for simplicity.

Referring to FIG. 1, the fence sections 11 are formed by injecting molding a polymer into a mold as is well known in the art. The panel 14 is formed with a leg 15 at one end and a leg 16 at the other end. The panel 14, as shown, has a simulated vertical siding 19 with vertical pilings 20 in the bottom portion and a simulated lattice 21 with longitudinal pieces 22 and vertical pieces 23 forming openings 24 in the top portion. A frame rail 25 extends between the leg 15 and the leg 16 at the top portion of the panel. An intermediate frame 26 rail extends between the posts at the boundary between the vertical siding and the lattice. Another frame rail 27 extends between the legs at the bottom portion of the panel. The panel 14 is approximately 23 inches wide and 44 inches long. This design may be reversed or other designs may be substituted therefore. The siding 19 and the lattice 20 may be imperforate, if desired.

In one embodiment, the legs 15, 16 extend above and below the panel 14. The foot 28 of the leg 15 rests on the ground or other surface and-supports the weight of the fence section 11 along with the foot 29 of leg 16. The space 30 between the ground and the bottom frame rail 27, along with the openings 24, allow air to circulate through the outdoor screen fence 10 to reduce loads caused by wind.

Figure 2:
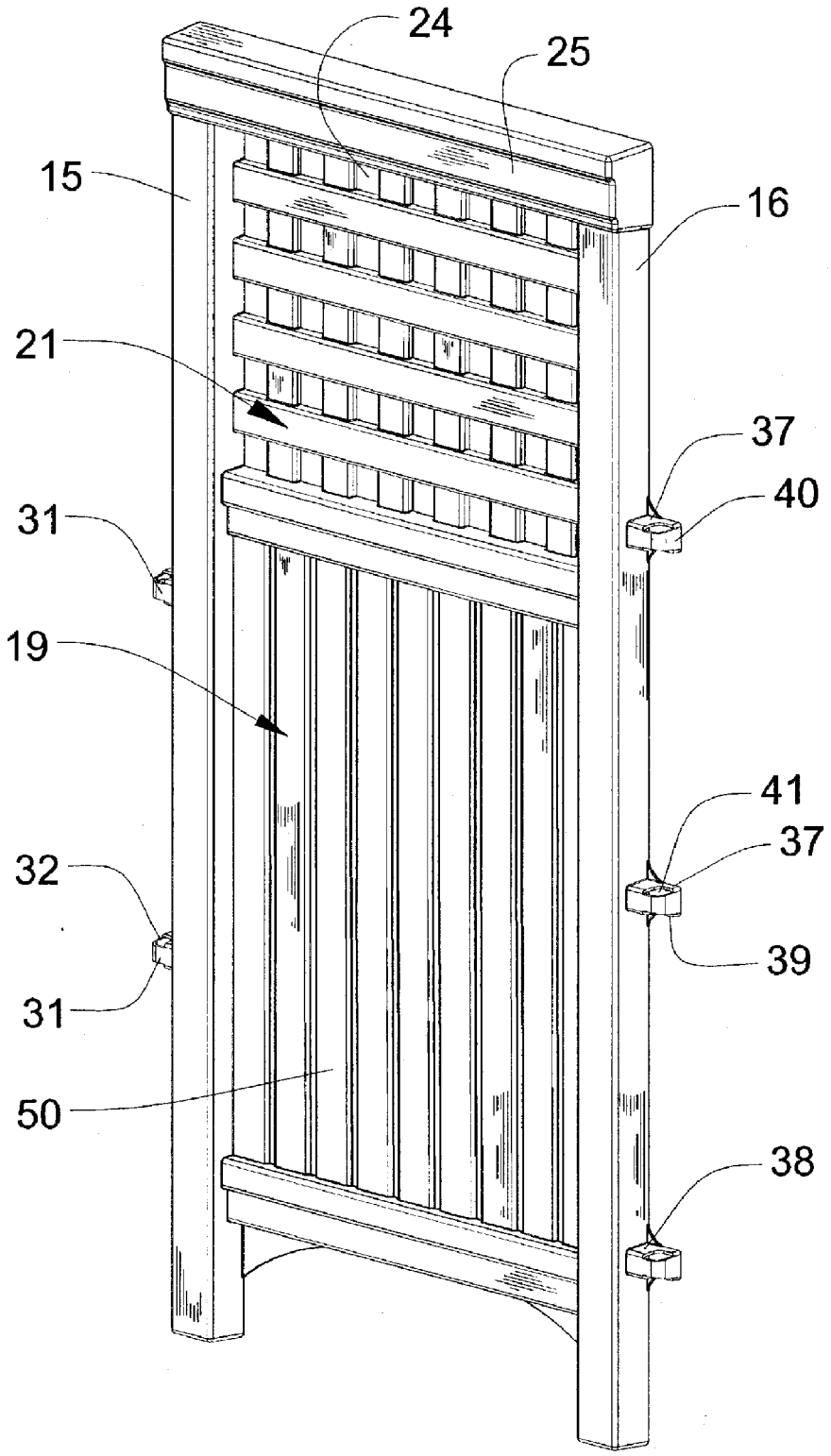
FIG. 2 is a front perspective of a panel of the outdoor screen fence of this invention.
Figure 3:
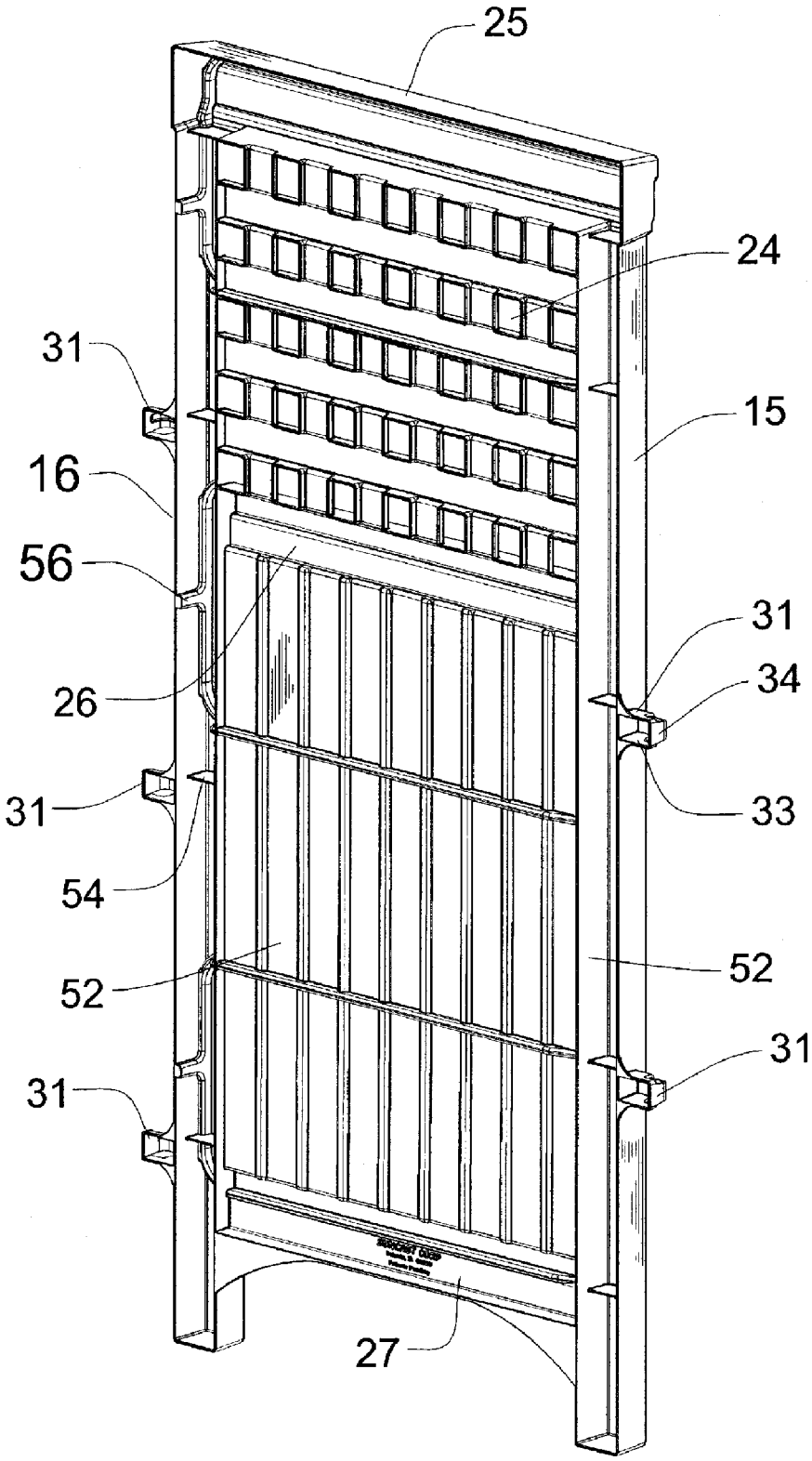
FIG. 3 is a back perspective of a panel of the outdoor screen of this invention.

As shown in FIGS. 1 through 7, the fence sections 11 are molded as a sheet with a three dimensional form presenting the positive front side 50 of the fence section 11, the lattice 21 and legs 15, 16 in relief with an apparent thickness of approximately 1½ inches. The back side 52 of the panels are substantially concave and include a plurality of integrally formed gussets 54 to provide strength and rigidity to the fence section. In addition to the gussets 54 the back side of the fence sections include integrally formed brace members 56. The brace members 56 extend along and between the panel and the legs in close proximity to the brackets 31 and provide substantial strength and rigidity to the fence sections 11 with a minimal addition of plastic. FIG. 1 shows the top end of leg 15 and leg 16 each with an end cap 17. The end caps 17 are integrally formed and close the top end of the legs and add rigidity to the fence section. FIGS. 2 and 3 show another embodiment of the fence with the top frame rail extending from leg to leg.

Figure 4:
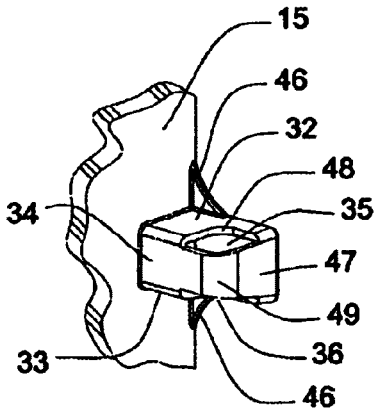
FIG. 4 is a perspective of a bracket of a panel of the outdoor screen fence of this invention.

The outer surface of leg 15 is formed with two integrally formed brackets 31 projecting outwardly, as shown in FIG. 4. The brackets 31 generally have a box construction, each having a top wall 32, a bottom wall 33, at least one sidewall 34 and an end wall 47. The sidewall 34 and the end wall 47 connect the top and bottom walls. Gussets 46 extend between both the top and bottom walls and the legs 15, 16. The gussets 46 provide increased strength and rigidity to the assembly. The top wall has an aperture 35 and the bottom wall has an aperture 36 aligned therewith. The apertures 35 and 36 are constructed and arranged to accept a post member 43. To provide additional support to the post member 43 the top and bottom walls 32, 33 include a support radius 48. In addition the sidewall 34 and end wall 47 include a second radius 49 extending therebetween. The first and second radius 48, 49 cooperate to provide increased contact area and support to assembled fence sections. Leg 16 includes three brackets 31 evenly spaced along the length thereof and leg 15 includes 2 brackets 31 spaced so that the brackets 15 are positioned between the brackets 31 on leg 15. This results in five brackets in alignment when the panels are joined, as shown in FIG. 1. The spaced brackets 31 permit the fence panels to be assembled along steep grades or uneven ground without interference (FIG. 7).

Figure 6:
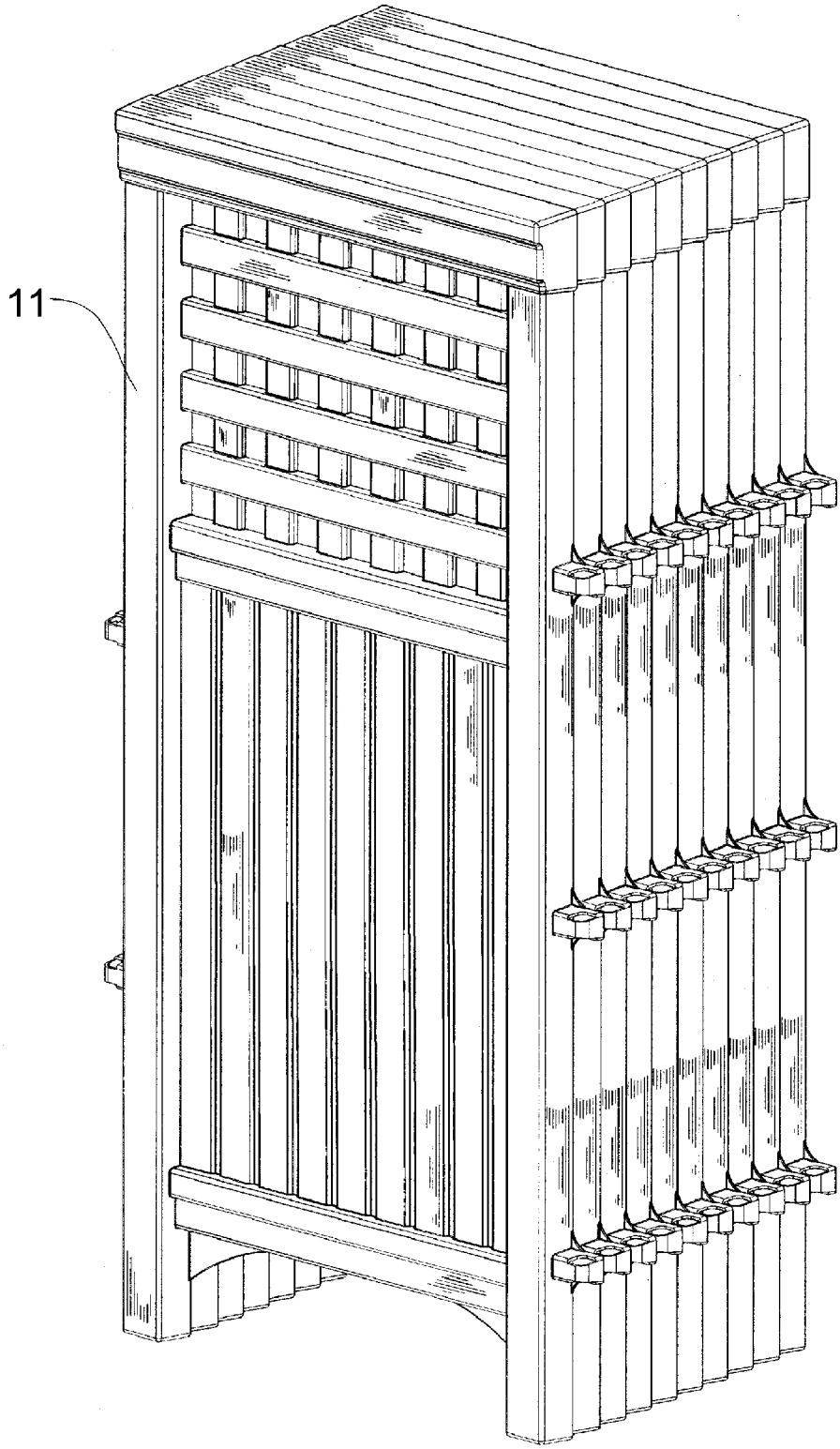
FIG. 6 is a perspective view of the instant invention fence sections illustrating a nested stack arrangement.

It should be appreciated that the shell-like construction of the fence sections 11 result in a lightweight fence section construction capable of distributing forces such as wind-loads over an increased area. The shell-like panel construction also permits the panels 11 to be stacked in a nested arrangement, as shown in FIG. 6, for shipping and storage purposes.

Figure 5:
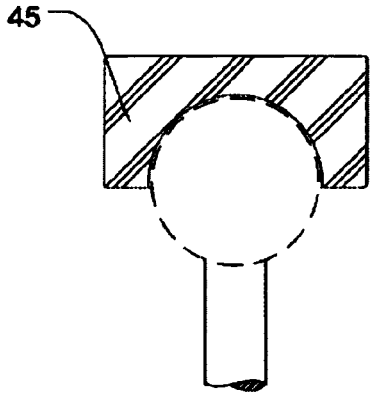
FIG. 5 is a cross section of the protective impact cap.
Figure 7:
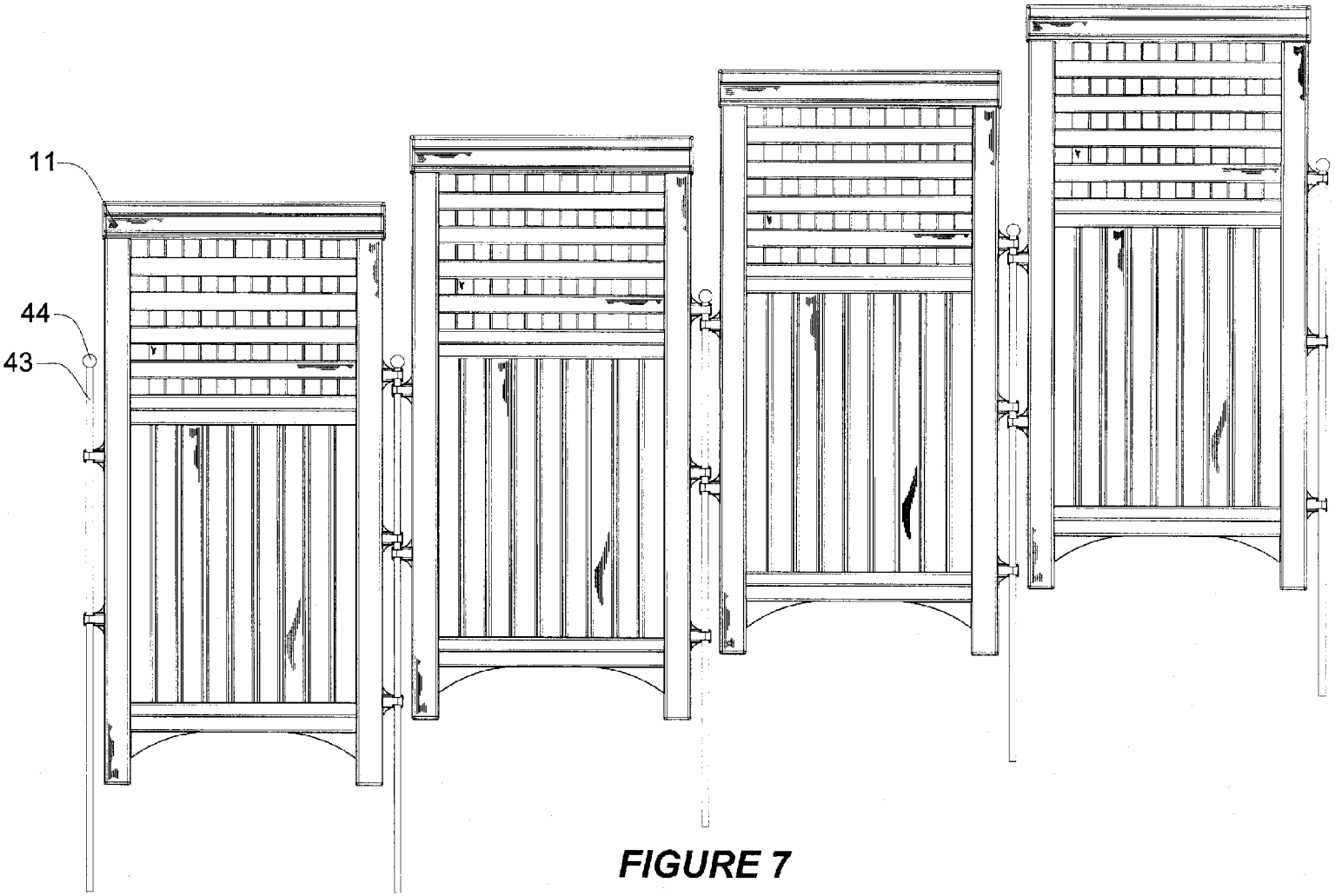
FIG. 7 is a front view of the instant invention fence sections illustrating the fence sections oriented for a sloped support surface.

Referring to FIGS. 1 and 7, to assemble the outdoor screen fence 10, a fence post 43 with a diameter somewhat smaller than the diameter of the apertures in the brackets, is passed through the apertures of the brackets 31 and 37 interlocking the separate panels 11 together. The fence post 43 may be a metal rod or tube, preferably steel, with a solid ball 44 on one end. The ball 44 forms a driving surface to be struck by any implement to drive the post into the ground or other surface. Of course, other geometric designs may be used for the ball. The fence post 43 in the preferred embodiment is coated with a suitable material to protect it from the elements. The coatings may include, but should not be limited to chrome, paint, plastic, rubber or suitable combinations thereof. To protect the coating on the ball 44 when driven into the ground, a plastic cap 45 shown in FIG. 5 is supplied. The plastic cap 45 is constructed and arranged to snap over the ball in a manner that secures it firmly in place during the installation process (FIG. 1). The fence post 43 is of such a length to extend beyond the bottom of the legs and anchor the fence to a support surface. In this manner the fence may be erected with the fence sections at any angle with respect to adjacent sections for aesthetics, as well as stability, and to form various shaped enclosures. The panels may move vertically along the posts to adjust to uneven ground (FIG. 7).

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

What is claimed is:

1. An outdoor screen fence kit for providing an enclosure and visual barrier comprising:

at least one fence section, said at least one fence section including a first leg formed at a first side, a second leg formed at a second side, an integral panel extending between said first leg and said second leg, said panel having a three dimensional front face, said panel having a substantially hollow back surface, said first leg including at least one integrally formed bracket extending outwardly therefrom, said at least one first bracket having a first aperture perpendicular to a width of said at least one first bracket, said second leg including at least one integrally formed second bracket extending outwardly therefrom, said at least one second bracket having a second aperture parallel to said first aperture;

at least one fence post member, said fence post member including a top driving portion and a bottom rod portion, wherein said rod portion is adapted to pass through said first aperture in said at least one first bracket and said second aperture in said at least one second bracket;

wherein like constructed fence sections are constructed and arranged to be aligned with said first and said second brackets in an interspersed relationship and wherein said bottom portion of said at least one fence post member has sufficient length to pass through said first and said second aligned interspersed brackets for cooperation with a support surface to provide polyaxial support for said like constructed fence sections, wherein said like constructed fence sections may be pivoted independently about said fence post, wherein said hollow back surface is constructed and arranged to cooperate with said front face of an identically constructed fence section to permit shipping in a nested arrangement, wherein the front face fits into the back surface.

2. The outdoor screen fence of claim 1 wherein said first leg and said second leg each extend below said panel to support said panel above said support surface.

3. The outdoor screen fence of claim 1 wherein said hollow back surface includes integrally formed brace members extending between and along said back surface and said first leg, wherein said brace members are constructed and arranged to increase the strength and rigidity of said fence section, wherein said brace members are constructed and arranged to cooperate with a front surface of a like constructed fence section to permit shipping in a nested arrangement.

4. The outdoor screen fence of claim 1 wherein said panel includes a perforated portion, wherein said perforated portion is constructed and arranged to permit air to flow therethrough.

5. The outdoor screen fence of claim 4 wherein said perforated portion includes lattice formed with vertical pieces and horizontal pieces, said vertical pieces and said horizontal pieces forming boundaries about openings through said panel.

6. The outdoor screen fence of claim 1 wherein said first leg includes two said first brackets extending outwardly therefrom and wherein said second leg includes three brackets extending outwardly therefrom, wherein said brackets are constructed and arranged for interspersed aligned relationship when said like constructed fence sections are placed in a juxtaposed relationship, wherein said brackets are constructed and arranged for vertical movement along said rod portion of said fence post for assembly along steep grades and uneven support surfaces.

7. The outdoor screen fence of claim 6 wherein an integrally formed first gusset extends between said top wall and one of said first or said second legs and wherein an integrally formed gusset extends between said bottom wall and one of said first or said second legs, whereby said first and said second gussets provide increased strength and rigidity to said fence panel.

8. The outdoor screen fence of claim 1 wherein said first and said second brackets each include a box construction, wherein said box construction includes a top wall, a bottom wall, at least one side wall and an end wall, wherein said at least one sidewall and said end wall connect said top and said bottom walls, wherein said top wall includes an aperture therethrough and wherein said bottom wall includes an aperture therethrough, wherein said top wall aperture and said bottom wall aperture are arranged in an aligned and substantially parallel relationship with respect to said legs, wherein said top wall aperture and said bottom wall aperture are constructed and arranged to accept said fence post member.

9. The outdoor screen fence of claim 8 wherein said at least one sidewall and said end wall include a support radius therebetween, wherein said support radius is constructed and arranged to provide increased contact area with said post member, whereby loads placed on said fence panel are dispersed over an increased area.

10. The outdoor screen fence of claim 1 wherein said fence kit includes an impact cap constructed and arranged to interlockingly cooperate with said driving portion of said fence post during assembly of said fence kit, wherein said impact cap is adapted to be struck by an implement when driving said rod portion into a support surface, said impact cap adapted to be removed leaving said driving surface undamaged.

11. The outdoor screen fence of claim 1 wherein said rod portion of said fence post is tubular.

12. The outdoor screen fence of claim 1 wherein said fence sections are constructed of a polymeric material.

13. The outdoor screen fence of claim 1 wherein said fence sections are constructed of plastic.

14. The outdoor screen fence of claim 1 wherein said first leg and said second leg have a front surface in alignment with and substantially parallel to said front surface of said panel and a side surface connected to said front surface in a substantially perpendicular relationship, said at least one integrally formed first bracket extending outwardly from said side surface of said first leg, said at least one integrally formed second bracket extending outwardly from said side surface of said second leg.

15. An outdoor screen fence kit for providing an enclosure and visual barrier comprising:

at least one fence section, said at least one fence section including a first leg formed at a first side, a second leg formed at a second side, an integral panel extending between said first leg and said second leg, said panel having a three dimensional front face, said panel having a substantially hollow back surface, said first leg including at least one integrally formed bracket extending outwardly therefrom, said at least one first bracket having a first aperture perpendicular to a width of said at least one first bracket, said second leg including at least one integrally formed second bracket extending outwardly therefrom, said at least one second bracket having a second aperture parallel to said first aperture;

at least one fence post member, said fence post member including a top driving portion and a bottom rod portion, wherein said rod portion is adapted to pass through said first aperture in said at least one first bracket and said second aperture in said at least one second bracket;

wherein like constructed fence sections are constructed and arranged to be aligned with said first and said second brackets in an interspersed relationship and wherein said bottom portion of said at least one fence cost member has sufficient length to pass through said first and said second aligned interspersed brackets for cooperation with a support surface to provide polyaxial support for said like constructed fence sections, wherein said like constructed fence sections may be pivoted independently about said fence post, wherein said first leg includes a plurality of said first brackets and wherein said second leg includes a plurality of said second brackets, wherein said first and said second brackets are arranged for an interspersed aligned relationship when said like constructed fence sections are placed in a juxtaposed relationship, wherein said fence sections may be assembled along steep grades or uneven support surfaces without bracket interference, whereby said assembled fence sections follow the contour of the steep slopes or uneven support surfaces, wherein said hollow back surface is constructed and arranged to cooperate with said front face of an identically constructed fence section to permit shipping in a nested arrangement, wherein the front face fits into the back surface.

* * * * *